US006886288B1

(12) United States Patent
Yocum et al.

(10) Patent No.: US 6,886,288 B1
(45) Date of Patent: May 3, 2005

(54) DEVICE FOR MOUNTING A SCOPE TO CARRYING HANDLE OF A RIFLE

(76) Inventors: Terry L. Yocum, 893 Rocky Run Rd., West Finley, PA (US) 15377; Daniel L. Yocum, 893 Rocky Run Rd., West Finley, PA (US) 15377

( * ) Notice: Subject to any disclaimer, the term of this patent is extended or adjusted under 35 U.S.C. 154(b) by 91 days.

(21) Appl. No.: 10/740,323

(22) Filed: Dec. 19, 2003

(51) Int. Cl.[7] ..... F41C 27/00
(52) U.S. Cl. ..... 42/127; 42/124; 42/148
(58) Field of Search ..... 42/127, 124, 148

(56) References Cited

U.S. PATENT DOCUMENTS 3,555,687 A * 1/1971 Joseph ..... 42/124
3,579,840 A 5/1971 Heinzel
4,092,793 A 6/1978 Ricks
D259,944 S 7/1981 Burris
4,310,980 A 1/1982 Pilkington
4,845,871 A * 7/1989 Swan ..... 42/127
4,876,815 A * 10/1989 Terrill ..... 42/139
4,905,396 A * 3/1990 Bechtel ..... 42/127
5,033,219 A 7/1991 Johnson et al.
5,111,587 A 5/1992 Plank
5,314,798 A 5/1994 Brust et al.
5,806,228 A * 9/1998 Martel et al. ..... 42/124

* cited by examiner

*Primary Examiner*—Jack Keith
*Assistant Examiner*—M. Thomson
(74) *Attorney, Agent, or Firm*—Theresa M. Seal

(57) ABSTRACT

A scope mounting device for mounting a scope to the carrying handle of a rifle includes a receiver plate disposed on the upper surface of the breech of the rifle, with the receiver plate supporting thereon springs that engage a primary mounting member that is slipped within and locked on to the carrying handle. The primary mounting member includes a top plate to which the scope and scope base are secured, and a bottom plate that includes a locking pin whereupon manually releasing the primary mounting member allows the springs to force the bottom plate upward so that the locking pin can lock to the under surface of the carrying handle thereby securing the primary mounting member to the carrying handle and mounting the scope to the rifle.

8 Claims, 5 Drawing Sheets

DEVICE FOR MOUNTING A SCOPE TO CARRYING HANDLE OF A RIFLE

FIELD OF THE INVENTION

The present invention pertains to snap on, snap off mounting devices, and more particularly pertains to a scope mounting device that mounts to the carrying handle of certain types of rifles.

BACKGROUND OF THE INVENTION

Firearms have long included sights mounted on the barrel for improving the accuracy and reliability of shooting. Generally the sight is a front sight—or peep sight—mounted adjacent the muzzle of the barrel of the firearm. In addition, a rear sight can be included that is mounted at the breech of the firearm. Aligning the object or target both horizontally and vertically within both the front and the rear sights, and keeping the object or target aligned therein, is a crucial factor in developing accurate shooting—marksmanship—skills. To further develop and enhance one's shooting skills, scopes of varying degrees of magnifying power can be mounted to the firearms, especially rifles—although it is now possible to mount scopes to certain types and calibers of handguns. However, situations may occur where it is not necessary to have both a mounted scope and a front or peep sight. Thus it would be desirable to be able to mount and a scope to the firearm for use when needed but capable of detachment from the firearm when not needed.

SUMMARY OF TH INVENTION

The present invention comprehends a device for mounting a scope to the carrying handle of a rifle and includes a primary mounting member and a receiver plate that cooperate for snapping together and locking to the carrying handle for mounting the scope to the rifle. The primary mounting member includes a top plate that is disposed above the carrying handle for supporting the scope and scope mount base, a side plate pendent from the top plate and disposed adjacent the left side of the carrying handle, and a bottom plate adjoined to the side plate and which is disposed within the opening of the carrying handle. The bottom plate includes a locking pin that projects upwardly from the surface of the bottom plate. Superposed on the top of the rifle adjacent the breech is the receiver plate, and three springs are supported on the upper surface of the receiver plate. With the receiver plate placed on the breech of the rifle, the primary mounting member is slipped within the carrying handle so that the bottom plate is positioned above the receiver plate. The bottom plate is then pressed against the springs so that the primary mounting member can be properly positioned relative to the carrying handle. The primary mounting member is then released allowing the springs to expand forcing the locking pin into a receiving hole in the under surface of the carrying handle and thereby locking the primary mounting member to the hand guard for mounting the scope to the rifle.

It is an objective of the present invention to provide a scope mounting device that allows for the placement of the scope on the firearm, and the removal therefrom, for acommodating different operative situations.

It is another objective of the present invention to provide a scope mounting device that allows for the quick and easy mounting of the scope to the firearm and the dismounting of the scope from the firearm.

It is still another objective of the present invention to provide a scope mounting device manufactured of lightweight, durable aluminum to facilitate the easy and quick installation and removal of the scope mounting device to and from the firearm.

Still another objective of the present invention is to provide a scope mounting device that allows for the use of the scope and peep sight at the same time.

Still yet another objective of the present invention is to provide a scope mounting device that is especially suitable for use with a AR 15 or M16A1 rifle.

These and other objects, features, and advantages will become apparent to one skilled in the art upon a perusal of the following detailed description when read in conjunction with the drawing figures and appended claims.

DETAILED DESCRIPTION OF THE PREFERRED EMBODIMENT

Illustrated in FIGS. 1–7 is a device for mounting a scope to the carrying handle of a rifle, and more specifically, the scope mounting device 10 is disposed within the inner opening of the carrying handle for engagement to the under surface of the carrying handle for locking the scope mounting device 10 to the carrying handle. Although the scope mounting device 10 is suitable for many different rifle models, the device 10 is especially suitable for two common military-type rifles—the M16A1 and the AR15 Colt. The scope mounting device 10 of the present invention allows for the easy and quick attachment and detachment of the device 10 to the rifle to meet the various kinds of operative situations that may occur, as for example, going from marksmanship practice on the rifle range to other types of situations where the scope is not needed.

Figure 1:
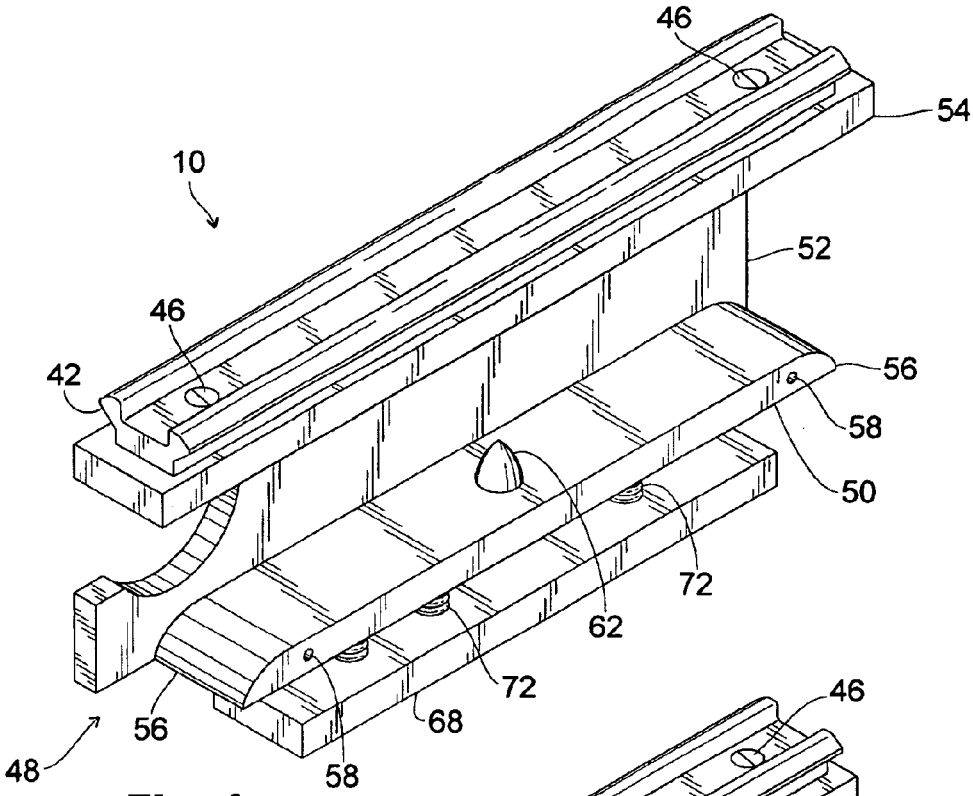
FIG. 1 is a perspective view of the scope mounting device of the present, invention illustrating the elements that cooperate to lock the device to the carrying handle of the rifle.
Figure 2:
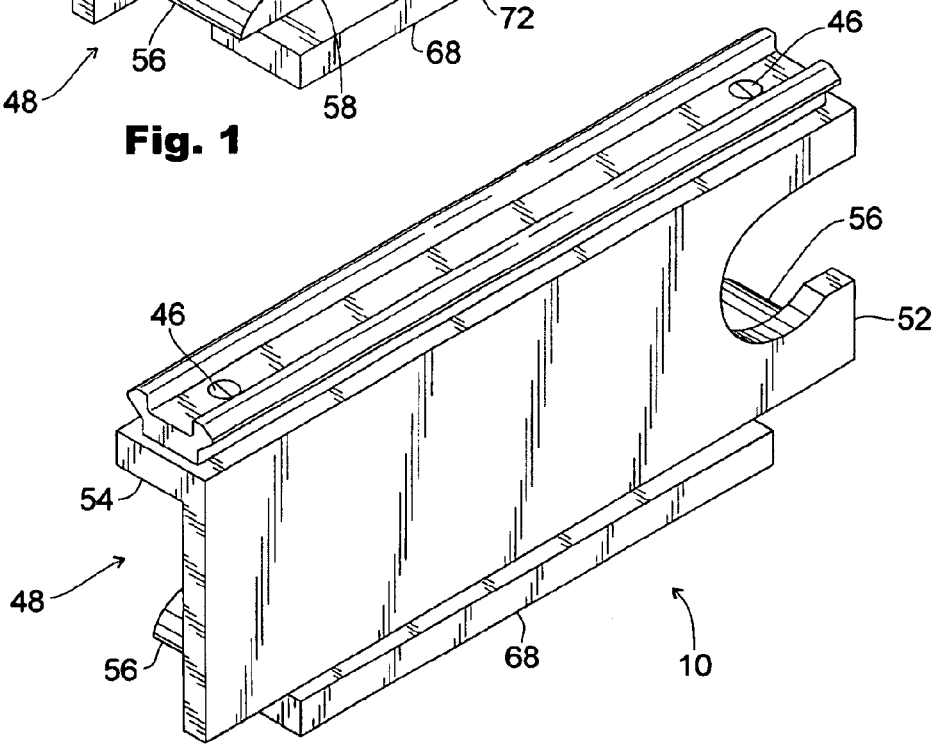
FIG. 2 is a perspective view of the scope mounting device of the present invention illustrating the exterior configuration of the scope mounting device.
Figure 3:
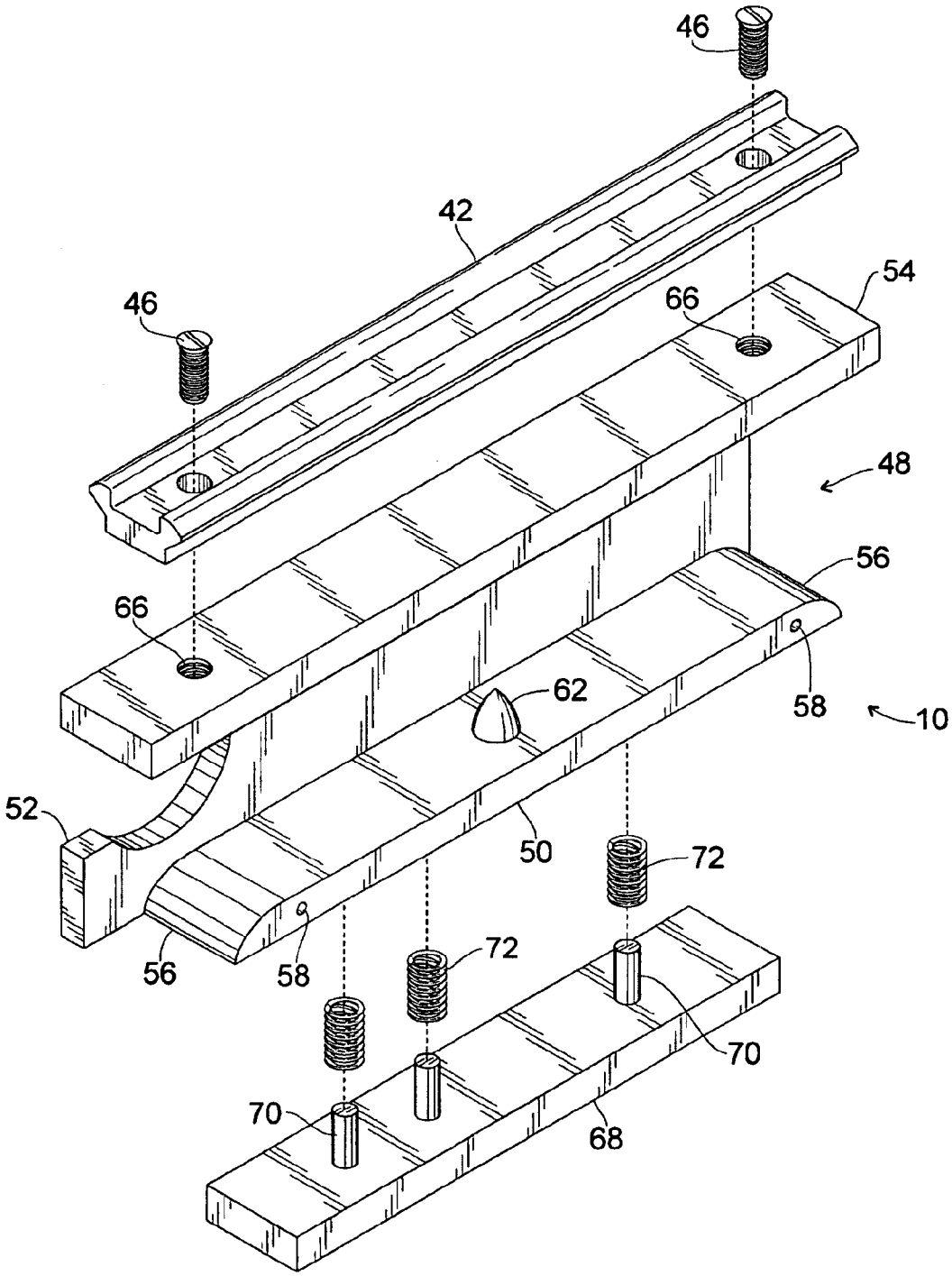
FIG. 3 is an exploded assembly view of the scope mounting device of the present invention.
Figure 4:
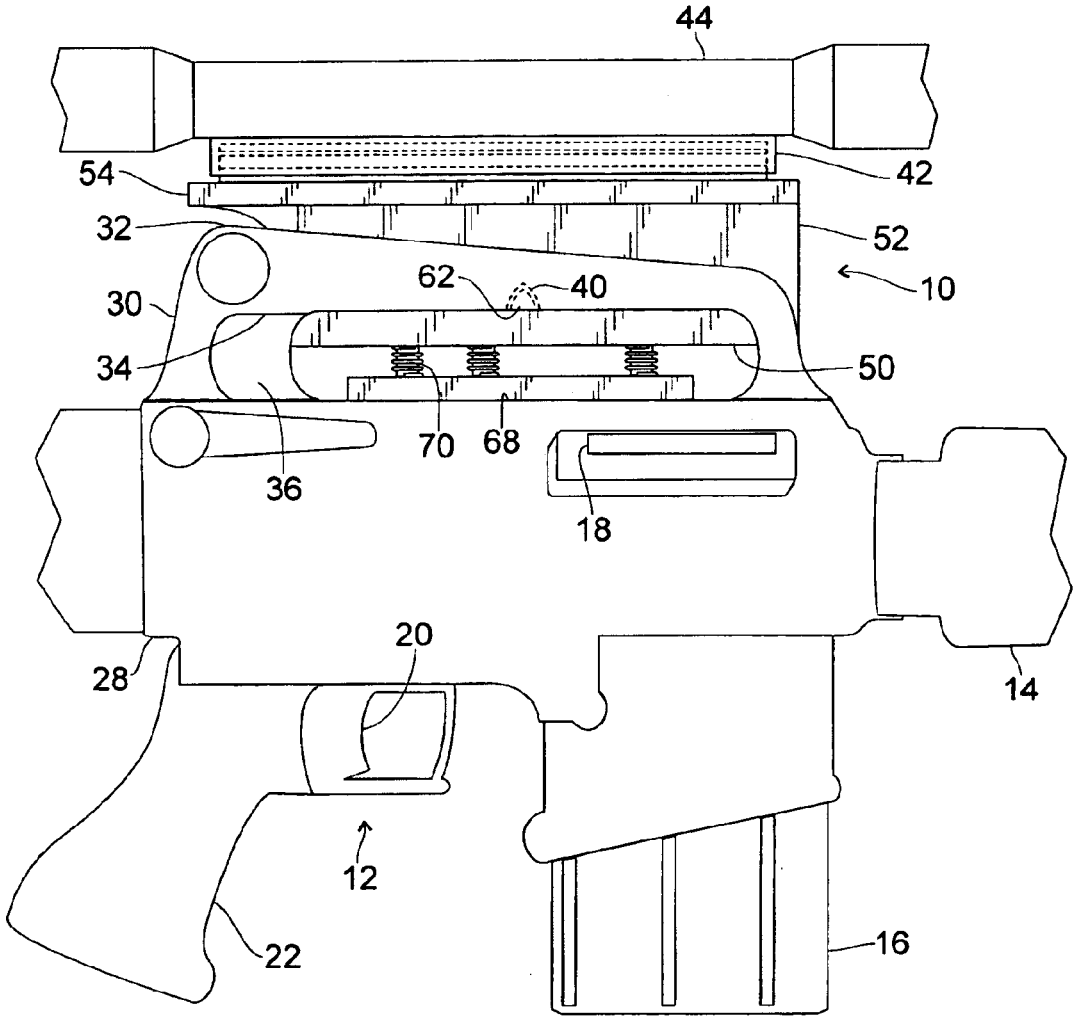
FIG. 4 is a sectioned side elevational view of the of the scope mounting device illustrating the securement of the scope mounting device to the carrying handle of the rifle.
Figure 5:
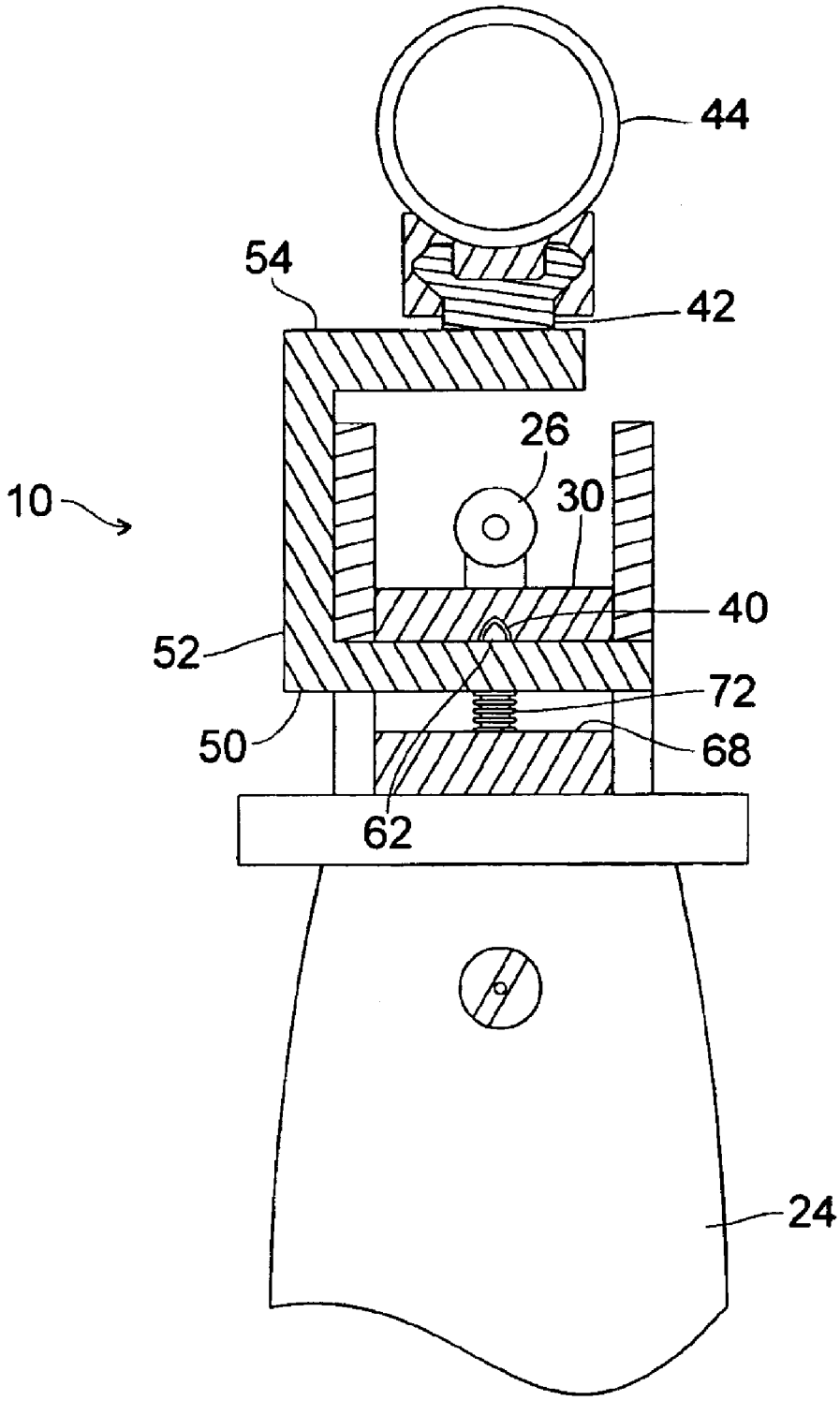
FIG. 5 is a rear elevational view of the scope mounting device of the present invention illustrating the securement of the scope to the carrying handle of the rifle.
Figure 6:
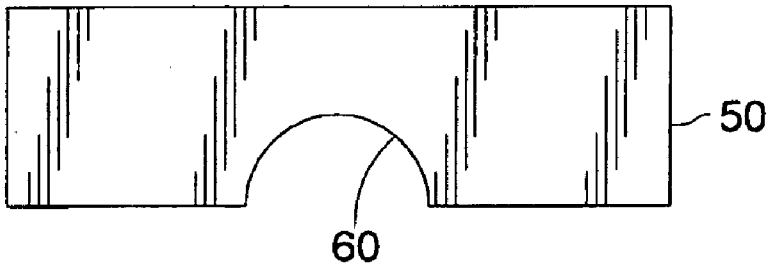
FIG. 6 is a side elevational view of the receiver plate illustrating the semi-circular groove along the bottom surface of the receiver plate.

Shown in FIGS. 4 and 5 is a representative example of the military-type rifle 12 that includes typical firearm elements such as a barrel 14, a magazine 16, an ejection port 18, a trigger 20, a hand grip 22, a butt plate 24, a peep sight 26, and a breech 28. In addition, the rifle 12 includes a hand guard 30 having an upper gripping portion 32 that has a bridge-like configuration, an under surface 34 of the upper gripping portion 32, and an inner opening or slot 36 into and through which the individual can insert his fingers and hands for grasping the upper gripping portion 32 of the carrying handle 30. Moreover, located on the under surface 34 of the upper gripping portion 32 is a receiving hole 40 that may be conical-shaped. As shown in FIGS. 1–4, a scope base mount 42, such as a 336 mount weaver, is removably attachable to the scope mounting device 10, and the rifle scope 44 is attached to the scope mounting device 10 by the scope base mount 42. The scope base mount 42 has a longitudinal slot and at least two threaded passageways with the slot accommodating the attachment of the scope 44 and the passageways for receiving fasteners 46 for securing the scope base mount 42 to the scope mounting device.

As shown in FIGS. 1–6, the scope mounting device 10 is a lightweight structure preferably manufactured from 6061 T aluminum and is designed to easily snap and lock onto the carrying handle 30 by using one hand, and for easy and quick removal or detachment from the carrying handle 30. Thus, the scope mounting device 10 can be snapped on the carrying handle 30 so that the scope 44 and peep sight 26 can both be used during marksmanship practice on the rifle range, and then the scope mounting device 10 can be detached from the carrying handle 30 and removed so that the rifle 12 can be used in different situations. It should be noted that for orientation purposes the left side and right side of the carrying handle 30 is taken from the perspective of the individual holding the rifle 12 and looking down the barrel 14.

Figure 7:
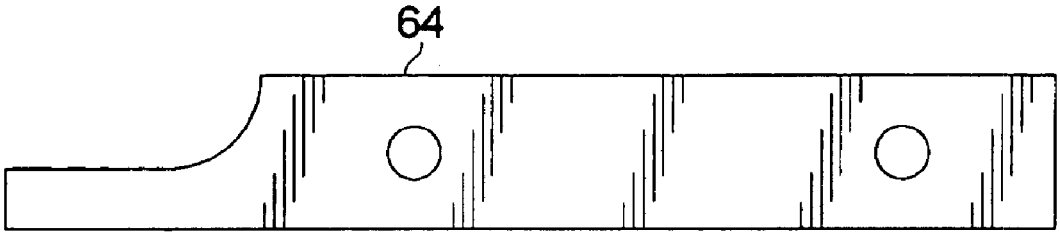
FIG. 7 is a side elevational view of an additional element that assists in securing the scope mounting device to the carrying handle adjacent the right side of the hand guard of the rifle.

As illustrated in FIGS. 1–6, the scope mounting device 10 includes an integral, one piece unit referred to as the primary scope mounting member 48. The primary mounting member 48 is channel or unshaped, and includes a bottom plate 50, a side plate 52 adjoined to the bottom plate 50, and a top plate 54 adjoined to the side plate 52. The bottom plate 50 includes opposed tapered ends 56 for conforming and fitting within the interior curvature or curvilinear contour that defines the opening or slot 36 of the carrying handle 30. On one side of the bottom plate 50—for purposes of orientation the right side when the bottom plate 50 is disposed in its operative position—are a pair of side apertures 58. In addition, the bottom plate 50 includes a half moon or semi-circular longitudinal slot 60 that is coequal in length with the bottom plate 50. The bottom plate 50 also includes a generally centrally positioned locking pin 62 that projects upwardly from the bottom plate 50, and the locking pin 62 fits within the receiving hole 40 of the upper gripping portion 32 for locking the scope mounting device 10 to the carrying handle 30. As shown most clearly in FIGS. 1 and 3, the side plate 52 slopes slightly downward from the back to the front so that the height of the scope mounting device 10 at the rear is 1 and ½ inches while the height at the front of the scope mounting device 10 is 1 and ¼ inches. Also, as shown in FIG. 7, a right side locking plate 64 can be used for securing the scope mounting device 10 to the carrying handle 30 from the right side of the carrying handle 30.

The top plate 54 includes a pair of spaced-apart threaded apertures 66 that are aligned with the passageways of the scope base mount 42 so that the fasteners 46 can be inserted through the passageways and into the apertures 66 for securing the scope base mount 42 to the top plate 54. The top plate 54 slopes slightly downward from the back to the front for facilitating the alignment of the scope 44 with the peep sight 26. The top plate 54 preferably has a length of six inches and a thickness of ¼ inch.

As shown in FIGS. 1–4, the scope mounting device 10 also includes a receiver plate 68 that is a separate structural element but cooperates with the primary mounting member 48 to secure and hold the primary mounting member 48 to the carrying handle 30. The receiver plate 68 is an elongated rectangular plate that is placed contiguous to that portion of the breech 28 of the rifle 12 located beneath the upper gripping portion 32 of the carrying handle 30. The receiver plate 68 includes a plurality of spaced-apart studs 70 with each stud 70 having a spring 72 placed thereon. The studs 70 assist in maintaining the alignment of the springs 72, as shown in FIG. 4, when the primary mounting member 48 is snapped in place on the carrying handle 30. As an alternative to the studs 70, the receiver plate 68 may include three circular recesses with each spring 72 being set in each respective recess.

In order to attach the scope mounting device 10 to the carrying handle 30 the receiver plate 68 is first securely placed on the portion of the breech 28 directly beneath the under surface 34 of the upper gripping portion 32 of the carrying handle 30. Holding the primary mounting member 48 adjacent the left side of the carrying handle 30, the individual would then position the bottom plate 50 within the inner opening 36 and immediately above the springs 72 of the receiver plate 68 with the slot 60 of the bottom plate 50 above and aligned with the upwardly projecting springs 72. The individual would then press down on the bottom plate 50 thereby pressing the springs 72 slightly downward to allow for the positioning of the bottom plate 50 within the inner opening 36 of the carrying handle 30. The individual would then let up on the primary mounting member 48 thereby allowing the springs 72 to expand forcing the bottom plate 50 upward so that the bottom plate 50 seats within the inner opening 36 of the hand guard 30 as shown in FIGS. 4 and 5. The upward movement of the bottom plate 50 causes the locking pin 62 to engage and lock into the receiving hole 40 located on the under surface 34 of the upper gripping portion 32 of the carrying handle 30. This action locks the primary mounting member 48 to the carrying handle guard 30 and the top plate 54, with the scope 44 and scope base mount 42 secured thereto, will extend above and over the carrying handle 30, as also shown in FIGS. 4 and 5, so that the scope 44 can be used with the peep sight 26.

While the foregoing specification sets forth a detailed description of the preferred embodiment of the invention, it will be understood that many of the details herein given may be varied considerably by those skilled in the art without departing from the spirit and scope of the invention.

We claim:

1. A device for mounting a scope to an upper gripping portion of a carrying handle of a rifle, comprising:

a receiver plate for disposition on the rifle adjacent a breech of the rifle;

a plurality of springs disposed on the receiver plate and projecting upwardly toward the upper gripping portion of the carrying handle;

a primary mounting member for placement on the carrying handle of the rifle;

the primary mounting member including a bottom plate having rounded opposed ends and a central locking pin, a side plate attached to the bottom plate, and a top plate attached to the side plate and spaced above the bottom plate, the top plate including at least two spaced-apart threaded apertures extending through the top plate; and the primary mounting member being mounted on the carrying handle by positioning the bottom plate above the springs of the receiver plate and then pressing the bottom plate down against the springs for positioning the top plate above the upper gripping portion of the carrying handle whereupon the primary mounting member can be manually released so that the springs contact the bottom plate and force the bottom plate upward for engaging and locking the bottom plate to the carrying handle thereby securing the primary mounting member and the scope to the rifle.

2. The device for mounting a scope to the carrying handle of the rifle of claim 1 wherein the upper gripping portion of the carrying handle includes an under surface having a receiving hole for insertion therein of the locking pin so that the bottom plate can be locked to the carrying handle guard.

3. The device for mounting a scope to the carrying handle of the rifle of claim 2 wherein the bottom plate includes at least two upwardly projecting studs with each stud having one spring placed thereon for maintaining the alignment of the springs when the springs engage the bottom plate of the primary mounting member.

4. The device for mounting a scope to the carrying handle of the rifle of claim 3 wherein the tapered ends of the bottom plate mate with an interior curvilinear configuration of the carrying handle when the bottom plate is brought into contact with the upper gripping portion of the carrying handle.

5. The device for mounting a scope to the carrying handle of the rifle of claim 4 wherein the threaded apertures of the top plate receive fasteners for securing a scope base mount on which the scope is attached to the top plate.

6. The device for mounting a scope to the carrying handle of the rifle of claim 5 wherein the bottom plate includes a semi-circular longitudinal groove that extends the length of the bottom plate for receiving the springs and maintaining the alignment of the springs so that the springs can keep the bottom plate in contact with the upper gripping portion of the carrying handle.

7. The device for mounting a scope to the carrying handle of the rifle of claim 6 wherein the primary mounting member is manufactured from aluminum.

8. The device for mounting a scope to the carrying handle of the rifle of claim 7 wherein the receiver plate is manufactured from aluminum.

* * * * *